United States Patent [19]

Quan

[11] 4,069,733

[45] Jan. 24, 1978

[54] COMBINED BRIDGE AND STRING ANCHORING DEVICE FOR STRINGED MUSICAL INSTRUMENTS

[76] Inventor: Glen D. Quan, 152 Jules St., San Francisco, Calif. 94112

[21] Appl. No.: 418,123

[22] Filed: Nov. 16, 1973

[51] Int. Cl.[2] ..... G10D 3/04; G10D 3/12

[52] U.S. Cl. ..... 84/299

[58] Field of Search ..... 84/297, 298, 299, 307, 84/312, 267

[56] References Cited

U.S. PATENT DOCUMENTS

| | | | |
|---|---|---|---|
| 2,714,326 | 8/1955 | McCarty | 84/299 |
| 2,740,313 | 4/1956 | McCarty | 84/307 |
| 2,972,923 | 2/1961 | Fender | 84/307 X |
| 3,440,920 | 4/1969 | Norwood | 84/312 |

FOREIGN PATENT DOCUMENTS

| | | | |
|---|---|---|---|
| 670,789 | 9/1963 | Canada | 84/299 |

*Primary Examiner*—Lawrence R. Franklin
*Attorney, Agent, or Firm*—Kurt A. Tauchen

[57] ABSTRACT

A compact adjustable bridge and string-anchoring structure for stringed musical instruments in the form of a bar whose top surface carries in juxtaposition bridge sections, one for each string, which are mounted for movement in a direction longitudinally of the strings and are equipped with means operable to vary their positions individually. Arranged in the front edge area of the bar are open anchoring recesses provided with small funnel-shaped apertures in their rear walls for the strings to pass through and emerge at the rear edge area of the bar while the beaded ends of the strings are retained and sheltered in the recesses. This rear edge area is smoothly rounded for the strings to be folded upwardly over said area into engagement with the individual bridge sections on the top surface of the bar. The opposite ends of the bar are provided with hook-like extensions for attachment of the ends of the bar to the body of the instrument in a manner permitting individual adjustment of the bar ends in a direction longitudinally of the strings and also relative to the top surface of the instrument body.

3 Claims, 6 Drawing Figures

Fig. 1
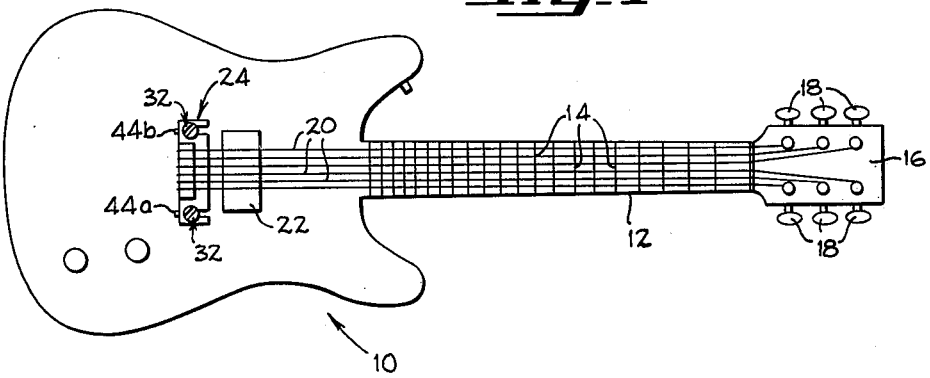
Fig. 2
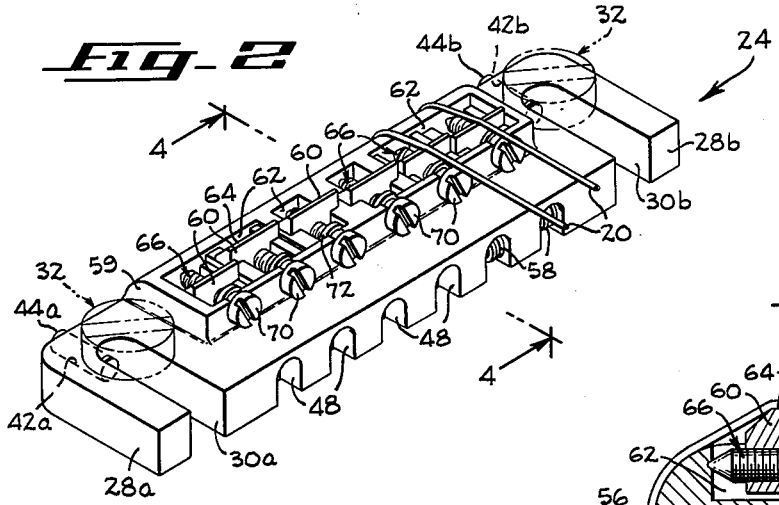
Fig. 4
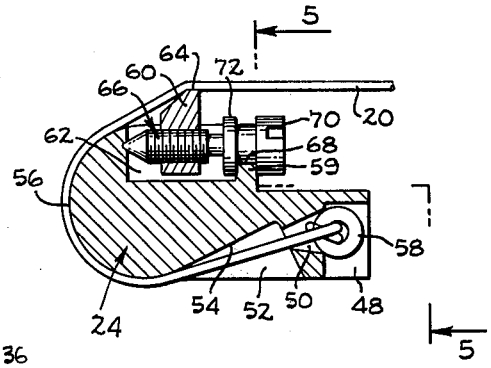
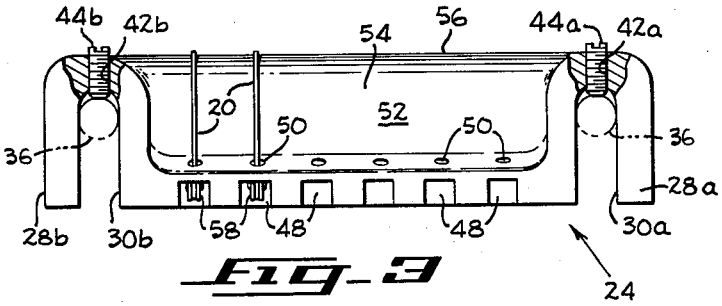
Fig. 3
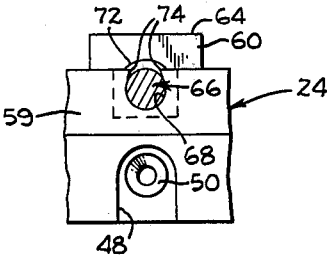
Fig. 5
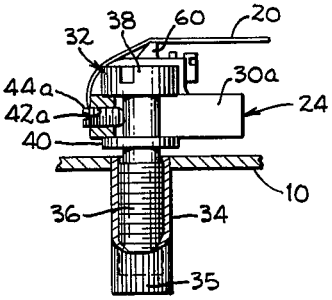
Fig. 6

COMBINED BRIDGE AND STRING ANCHORING DEVICE FOR STRINGED MUSICAL INSTRUMENTS

The present invention relates to stringed musical instruments, especially stringed musical instruments having fretted necks such as Guitars, Basses and Mandolins. Stringed musical instruments are equipped with "bridges" i.e. support structures on the body of the instruments that lift strings tensioned between an anchoring device on the body of the instrument and the tuning keys in the head of the instrument above the surface of the body and the neck of the instrument, and by contact of their support ledges with the strings they determine the effective length and hence the fundamental frequency of the active sound-producing portion of the strings. Strings differ in quality, even those intended to produce the same notes, and portions of the very same string may differ in quality, for instance may be of non-uniform thickness longitudinally thereof. Also there may be gross irregularities in the construction of the body of the instrument. It is therefore frequently desirable to provide special adjustments beyond and in addition to the tuning keys in the neck of the instrument to obtain proper performance. For instance, it may be desirable to adjust the total effective length and tension of all or some of the strings individually and to raise or lower them as a whole relative to the upper surface of the neck and body of the instrument; and it may even be necessary to tilt the string supporting bridge ledge both about a vertical or a horizontal axis.

OBJECTS OF THE INVENTION

It is an object of my invention to provide a bridge structure for attachment to the body of stringed musical instruments, that provides all these adjustment possibilities.

More particularly it is an object of the present invention to provide a bridge structure of the type referred to, that permits individual adjustment of the individual strings and also adjustment of the strings as a whole, i.e. where all of them may be raised or lowered relative to the top surface of the body and neck of the instrument, and may be tilted if desired.

An additional object of the invention is to construct a bridge structure of the type described in such a manner that it may serve as an anchoring device for the beaded ends of the strings so that a separate tailpiece on the body of the instrument is no longer required; and most important it is an object of the invention to provide a bridge structure that serves all these functions, and is yet of simple and compact construction.

SUMMARY OF THE INVENTION

In accordance with the invention the combined bridge and string-anchoring device takes the form of a bar whose top surface carries in juxtaposition bridge sections which are mounted for individual adjustment in a direction longitudinally of the strings, and the front edge area of the bar is provided with string-anchoring means in the form of recesses having apertured end walls so that the strings may pass through the apartures to emerge at the rear end area of the bar while the beaded ends of the strings are retained and sheltered in the recesses. The rear edge area of the bar is smoothly rounded so that the strings may be folded smoothly around said rear edge area to the top surface of the bar for engagement over the individual bridge sections. The bar is attached to the body of the instrument by means, at the opposite ends of the bar, which permit individual adjustment of the location of these opposite ends in a direction longitudinally of the strings and of their height relative to the top surface of the instrument body.

BRIEF DESCRIPTION OF THE DRAWING

The invention will best be understood by reference to the accompanying drawing which illustrates a preferred embodiment and wherein FIG. 1 is a plan view of a guitar equipped with a combined bridge and string-anchoring device embodying my invention;

FIG. 2 is a perspective of the device of my invention;

FIG. 3 is a bottom plan view of the device;

FIG. 4 is a vertical section through the device taken along line 4—4 of FIG. 2 and viewed in the direction of the arrows associated with said line;

FIG. 5 is a fragmentary front elevation of a vertical section through the device taken along line 5—5 of FIG. 4 and viewed in the direction of the arrows associated with said line; and FIG. 6 is a detail view, partly in section and with a portion broken away, illustrating the bolt by means of which the ends of the device of my invention are adjustably secured to the body of the guitar.

DETAILED DESCRIPTION OF A PREFERRED EMBODIMENT OF THE INVENTION

Referring first to FIG. 1, the reference numeral 10 designates the body of the guitar, which has a neck 12 with frets 14, and a head 16 with the conventional keys 18 for tuning the strings 20. The strings pass over a pick-up 22 of conventional design mounted upon the body of the instrument and are anchored in the device of my invention which is collectively identified by the reference numeral 24 and is adjustably held upon the body of the instrument. This device has roughly the shape of a bar (FIG. 2) that is disposed transversely of the body of the guitar. On its opposite ends it is provided with hook-shaped extensions **28*a* and 28*b* that point in a direction forwardly of the instrument i.e. toward the head 16 (FIG. 1), and which define two deep recesses 30*a* and 30*b*, respectively, (FIG. 2) which are open in a direction forwardly of the instrument to be engaged over and receive bolts 32 that are securely anchored in body of the instrument (FIG. 6**).

The bolts 32 are of such construction that they may be manipulated to raise or lower the device of the invention relative to the body of the instrument. Having reference to FIG. 6, the bolts 32 have internally threaded base bushings 34 that are firmly secured to the body of the instrument and which may have fluted outer surfaces as shown at 35, to resist rotation relative to the instrument body; and threadably engaged in said bushings are the screw bolts proper 36 which rise above the bushings and are provided with a slotted screw head 38 of conventional design. Below the heads the bolts carry firmly secured thereto disks 40 with smooth upper surfaces. The distance between the bottom surfaces of the screw heads and the top surfaces of the discs is such that they will smoothly receive the vertical thickness of the hooks 28 on the opposite ends of the device of my invention. By turning the screws 36 they may be made to rise higher or descend deeper into the bushings 34 and thus the device of my invention as a whole or one or the other end thereof may be raised higher above, or brought closer to, the upper surface of the body of the instrument, as the case may be.

The bight portions of the hooks 28*a* and 28*b* on the opposite ends of the device of the invention are provided with threaded apertures 42*a* and 42*b* extending longitudinally of the instrument which are engaged by screw bolts 44*a* and 44*b* respectively (FIGS. 2, 3 and 6). The outer ends of these screw bolts are provided with drive slots and their inner ends bear against the stem portions 36 of the screws 32 of the described bridge-raising and lowering mechanism. Thus, when the bridge assembly of my invention is installed in place upon the body of the instrument, its position relative to the body of the instrument longitudinally thereof may adjusted by turning the screws 44*a* and 44*b*, and it may even by imparted a slightly tilted or oblique position, if desired, by turning one or the other of these screws.

The device of my invention is of such construction that it may serve to anchor the strings 20 therein so that the tailpiece customarily found on the body of stringed instruments may be dispensed with. Having reference to FIGS. 2 and 5, the front edge of the device of my invention has formed therein a plurality of relatively spaced tunnel-shaped recesses 48, one for each of the strings comprised in the instrument. The rear walls of these recesses are provided with funnel-shaped apertures 50 of substantially smaller compass than the recesses (FIGS. 4 and 5) which lead into a space 52 formed by a depression in the underside of the device of the invention (FIG. 4). The roof or ceiling 54 of this space slants to the level of the underside surface of the device where it turns upwardly and forms a smoothly rounded rear edge area 56. In applying the strings to the instrument, the free ends of the strings are threaded through the funnel-shaped apertures 50 and the strings are pulled through said apertures. They are then passed along the rounded rear edge surface of the device and over bridge members 60 provided on the top surface of the device until the bead-shaped anchor fittings 58 at their opposite ends strike against the end wall of the tunnel-shaped recesses 48 and are unable to pass through the apertures 50. Thus the strings are firmly anchored in the device of the invention.

Additionally, the device of my invention provides means for shifting the contact point of the bridge members 60 for each string so that the effective length of each string and its degree of tension may be adjusted individually with a very high degree of precision, and the harmonics of the strings determined by the frets be accurately established irrespective of non-uniformities in the quality of the individual strings or irregularities and discrepancies in the location or structure of the frets.

Having reference to FIGS. 2 and 4, formed in a raised platform 59 on the top surface of the device are a plurality of juxtaposed chambers 62 of rectangular shape one for each of the strings comprised in the particular instrument for which the device of the invention is designed; and in each of said chambers is mounted for movement in a direction longitudinally of the instrument one of the herein before mentioned bridge segments 60. These segments have the form of small blocks forming narrow upper ledges 64 for the strings to rest on. To adjust the position of these blocks, they are engaged over screws 66 which are rotatably held in the front and rear walls of the chambers 62 and are constrained from movement in a direction longitudinally of the instrument. For this purpose the screws rotate in U-shaped recesses 68 (FIG. 5) in the front wall of the chambers with their slotted heads 70 bearing against the outer surface of said front wall, and discs 72 on the stem of the screws bearing against the inner surface of said front wall (FIG. 4), while the pointed ends of the screws engage small apertures in the rear wall of the chambers 60. The blocks 60 are constrained from participating in any rotation of the screws, and for this purpose have lateral extensions somewhat in the manner of the cross bar of a T (FIG. 5) which bear against the dividing walls of the chambers 62 or special ledges formed on and along the side walls of the chambers as best shown in FIG. 2. Thus, when the screws are turned by turning their heads 70 with the aid of a screw driver, the blocks 60 will move in small increments forwardly or rearwardly within their chambers 62 depending upon the direction in which the screws are turned, and in this manner the effective length and tension of each string may be very precisely adjusted.

To avoid accidental disengagement and possible loss of a bridge section 60 from the device of my invention during manipulation of the screw heads 70, the upper edges of the U-shaped recesses 68 may be peened slightly over the stem portions of the screws 66 as shown at 74 in FIG. 5. Care should be taken, however, that it remains still possible, in spite of the peened retaining lips 74, to force the screws past the retaining lips through the open upper end of the recesses 68 whenever this may be necessary for exchange and replacement.

The structure of my invention makes it possible to raise or lower the total string-supporting bridge relative to the top surface of the instrument body, to move it forwardly or backwardly in a direction longitudinally of the instrument, or even to tilt it relative to a horizontal or vertical plane if this should become necessary to provide compensation for gross irregularities in the construction of the instrument. It also makes it possible to adjust the string-supporting ledges 60 individually for each string so that the effective length and tension of each string may be adjusted very accurately. In addition the device of my invention makes provision for anchoring the beaded ends of the strings securely in position upon the body of the instrument so that tailpieces or other separate string-anchoring devices are now superfluous and may be dispensed with, yet with all these functions and adjustment possibilities the device of the invention is of an extremely compact and relatively simple construction.

I claim:

1. A combined bridge and string-anchoring device for stringed musical instruments comprising a bar having a top surface, a front edge area, a rear edge area and opposite end areas, a series of string-supporting bridge sections mounted in juxtaposition upon said top surface for movement in a direction longitudinally of the strings of the instrument to which the bar is attached, means operable from the front edge area of said bar for individually adjusting the position of said bridge sections, and means in said front edge area for retaining the beaded ends of the strings, while allowing the strings to pass to said rear edge area to be folded over said rear edge area and engaged over said bridge sections.

2. Device according to claim 1 wherein said front edge area has a series of tunnel-shaped recesses formed therein to receive and shelter the beaded ends of the strings, and funnel-shaped apertures formed in the end walls of said recesses for the strings to pass through to said rear edge area.

3. A combined bridge and string-anchoring device for stringed musical instruments in the form of a bar having a top surface, a front edge area, a rear edge area and opposite end areas, means at said end areas for detachably securing the opposite ends of the bar to the body of the instrument in a manner permitting individual adjustment of the location of said ends in a direction longitudinally of, and at right angles to the top surface of the instrument, a series of bridge sections mounted in juxtaposition upon said top surface for individual movement in a direction longitudinally of the instrument, means operable from said front edge area for individually adjusting the location of said bridge segments, and formed in said front edge area a series of juxtaposed, relatively spaced tunnel-shaped recesses having funnel-shaped apertures in their end walls for the strings to pass through to the bottom of said rear edge area while the beaded ends of the strings are retained and sheltered in said tunnel-shaped recesses, said rear edge area being of smoothly rounded contour for the strings emerging from said apertures to be folded upwardly along said rear edge area into engagement with said bridge sections.

* * * * *